US005926093A

United States Patent [19]

Bowers et al.

[11] Patent Number: 5,926,093

[45] Date of Patent: Jul. 20, 1999

[54] DRIVE CIRCUIT FOR REACTIVE LOADS

[75] Inventors: John H. Bowers, Clarksburg; Alan Dutcher, West Deptford, both of N.J.

[73] Assignee: Checkpoint Systems, Inc., Thorofare, N.J.

[21] Appl. No.: 08/911,843

[22] Filed: Aug. 15, 1997

[51] Int. Cl.[6] ..... G08B 13/14

[52] U.S. Cl. ..... 340/572.1; 340/825.3; 340/825.54; 343/860; 375/306

[58] Field of Search ..... 340/572, 825.3, 340/825.54, 572.1; 375/306; 343/860

[56] References Cited

U.S. PATENT DOCUMENTS

| | | | |
|---|---|---|---|
| 3,752,960 | 8/1973 | Walton | 340/825.3 |
| 3,796,958 | 3/1974 | Johnston et al. | 375/306 |
| 3,816,708 | 6/1974 | Walton | 340/825.3 |
| 4,223,830 | 9/1980 | Walton | 235/380 |
| 4,580,041 | 4/1986 | Walton | 235/380 |
| 4,857,893 | 8/1989 | Carroll | 340/572 |
| 5,025,273 | 6/1991 | Bowers | 347/128 |
| 5,036,308 | 7/1991 | Fockens | 340/572 |
| 5,099,226 | 3/1992 | Andrews | 340/572 |
| 5,463,376 | 10/1995 | Stoffer | 340/572 |
| 5,493,312 | 2/1996 | Knebelkamp | 343/860 |

OTHER PUBLICATIONS

Sokal, N.O. "Class E Switching–Mode RF Power Amplifiers," *R.F. Design*, Summer 1980, 33–38.

Raab, F.H. "Effects of Circuit Variations on the Class E Tuned Power Amplifier," *IEEE Journal of Solid–State Circuits*, vol. SC–13, No. 2, Apr. 1978, 239–247.

Sokal, N.O. "Class E—A New Class of High–Efficiency Tuned Single–Ended Switching Power Amplifiers," *IEEE Journal of Solid–State Circuits*, vol. SC–10, No. 3, Jun. 1975, 168–176.

Raab, F.H., "Idealized Operation of the Class E Tuned Power Amplifier," *IEEE Transactions on Circuits and Systems*, vol. CAS–24, No. 12, Dec. 1977, 725–735.

*Primary Examiner*—Benjamin C. Lee

*Attorney, Agent, or Firm*—Panitch Schwarze Jacobs and Nadel, P.C.

[57] ABSTRACT

A highly efficient resonant switching driver circuit includes a matching reactance coupled between an output resonant circuit and a driver circuit. The matching reactance performs a series to parallel impedance match from the driver circuit to the output resonant circuit.

6 Claims, 3 Drawing Sheets

DRIVE CIRCUIT FOR REACTIVE LOADS

BACKGROUND OF THE INVENTION

The present invention relates generally to a circuit for driving a reactive load, and more particularly, to a highly efficient resonant switching circuit for converting DC current into sinusoidal circulating currents in reactive loads at radio frequencies. The present invention can be used, for instance, for driving reactive (inductive) loop antennas such as that used in an interrogator for an electronic article surveillance (EAS) system.

A drive circuit with a resonant circuit is commonly used to enable the efficient conversion of energy from a DC power supply to a reactive load. FIG. 1 shows, in generalized form, a prior art drive circuit 100 for driving a reactive (inductive) load 102 (Ls). The drive circuit 100 includes a current switch device Qs, a resonance capacitor (Cs) and loss element (Ro), the latter representing the power losses associated with the resistances of the reactive load Ls 102 and the capacitor Cs and any additional resistance that may be connected to the circuit 100. The design of the circuit 100 is optimized for delivering power into the loss element (Ro), rather than reactive energy into the inductive load (Ls). Thus, the analysis of the efficiency of the circuit 100 is commonly relative to the amount of power delivered to the loss element (Ro). The following discussion refers to this common method of analysis. (An additional resistance may be made a part of the resonant circuit comprising Ls and Cs, for example, to increase the resonance bandwidth).

FIG. 2 shows voltage and current waveforms 102, 104 typically associated with the drive circuit 100. The upper waveform 104 shows the voltage (Vs) across the current switch device Qs and the capacitor Cs resulting from the current switching performed by the current switch device Qs. The lower waveform 106 shows the current (Ils) that flows through the reactive load Ls.

It is desirable to operate drive circuits for reactive loads with the highest possible efficiency. Inefficient drive circuits require larger power supplies. Inefficient drive circuits also waste substantial power in the form of heat, and thus require large heat sinks and/or cooling fans for heat removal, and are often less reliable. The nature of the current switch device Qs determines the efficiency of the prior art drive circuit 100. In particular, the percentage of the time the switch device Qs is made to operate in the linear mode, a mode where the current is made to vary as a continuous function of time instead of an on/off function of time, determines the so called class of operation of the prior art drive circuit 100.

In reactive load driver circuits, such as the drive circuit 100, the power conversion efficiency is generally referred to as the amount of power dissipated by the loss element Ro (the resistive losses of the circuit). Thus, the power conversion efficiency is the percentage of the power dissipated in Ro divided by the total power consumed by the drive circuit 100 (the sum of the power delivered to Ro and the power dissipated by current switch device Qs).

Commonly known classes of operation of the drive circuit 100 are Class A, Class B and Class C. Class A operation refers to operating Qs in the linear mode 100% of the time. Class A operation is very inefficient because of the power dissipated across the current switch device Qs. This power dissipation is caused by the simultaneous voltage across and current flow through the current switch device Qs, that results from the linear mode of operation of Qs. Class A operation of the prior art drive circuit 100 has a theoretical maximum efficiency of 25%.

Class B operation of the circuit 100 refers to operating the current switch device Qs in the linear mode for about 50% of the time. In other words, the switch device Qs is made to operate linearly for about one half of each cycle of the drive waveform. The maximum theoretical power conversion efficiency for Class B operation of the prior art circuit 100 is 78.65%, although practical implementations often achieve less than 50% efficiency.

Class C operation of the circuit 100 refers to operating the current switch device Qs in the linear mode for less than 50% of the time. In fact, Class C operation of the circuit 100 may operate the current switch device Qs predominantly as an on/off switch, thus not making it suitable for true linear amplification applications. The conduction time diagram shown in FIG. 2 is for Class C operation. Class C operation of the prior art circuit 100 achieves the highest efficiency operation, often between 40% and 80% in practical applications. Such efficiencies still do not fulfill the objective of the present invention.

FIG. 3 shows a prior art "flyback" drive circuit 108, commonly used as a horizontal deflection drive circuit in CRT displays (televisions and monitors). When used as a deflection drive circuit in CRT's, the drive circuit 108 includes a high voltage transformer (Ls), a current switching device (Qs), and a resonance capacitor (Cs). The drive circuit 108 may also include a large value coupling capacitor (Cc), to prevent DC current from flowing through the deflection coil (Lo) inductance that would cause horizontal positioning errors in the CRT display.

The drive circuit 108 may be characterized as a resonant switching drive circuit because the current switching device Qs is operated strictly in the on/off mode. The resonant part of the drive circuit 108 is formed by the parallel combination of the deflection coil (Lo) and the high voltage transformer (Ls) in conjunction with the resonance capacitor (Cs). When operated as a horizontal deflection circuit, the current switching device Qs is closed for the sweep duration (about 80% of the total period), causing a flat bottomed voltage waveform to be applied across the deflection coil (Lo). (See waveforms Vs and Vo in FIG. 3). During the time that the current switching device Qs is on, the supply voltage (Vsp) is applied across the inductors (Ls) and (Lo). As is well known in the art, the currents that flow through Ls and Lo increase linearly during this time. This linear current increase is desirable in that it causes a more or less linear deflection of the electrons of the CRT as a function of time, thereby causing a more or less uniform distribution of information across the screen of the CRT.

When the switching device Qs opens during the so called flyback time (about 20% of the total period), the energy stored in the inductors Ls and Lo is transferred in resonant fashion to the resonance capacitor (Cs). This results in the generation of the high voltage half sinusoid signal across the capacitor (Cs), the peak of which is much higher in amplitude than the power supply voltage (Vsp). Thus, the voltage across the inductors Ls and Lo is reversed, as compared to the voltage applied across them when the current switching device Qs was closed, thereby causing the current flowing through them to reverse, which in turn, causes the capacitor (Cs) to discharge and transfer its stored energy back to the combination of inductors Ls and Lo. This charge and discharge of the capacitor (Cs) is known as flyback and occurs in a sinusoidal manner, thus resulting in the half-sine flyback pulses that are indicative of the operation of the drive circuit 108.

The flyback drive circuit 108 converts DC power to reactive energy at RF frequencies very efficiently. Since the current switching device (Qs) is used as a switch, and not as a linear device, the power losses associated with Qs can be very low. Unfortunately, the flyback drive circuit 108 is not suitable for driving an inductive loop antenna because of the high harmonic content of the signal it generates. These harmonics radiate, thereby creating a high level of emissions outside of the frequency range of the intended radiation, which is unacceptable to government radio regulation authorities, such as the U.S. Federal Communications Commission.

FIG. 4 shows a prior art Class E drive circuit 110 for driving an inductive load (Lo). The circuit 110 includes a current switching device (Qs), a switch capacitor (Cs), a DC feed inductor (Ls), a resonance capacitor (Co), the output inductor (Lo) (which may be an inductive loop antenna), and a loss element (Ro), the latter representing the power losses associated with the resistances of Ls, Cs, Co, Lo and any additional resistance that may be connected to the circuit 110. (As with the circuit 100 of FIG. 1, an additional resistance may be made a part of the resonant circuit comprising Lo and Co, for example, to increase the resonance bandwidth).

FIG. 5 shows the voltage and current waveforms associated with the Class E drive circuit 110. A half-sine flyback pulse 112 is produced at the switching device Qs by the switch capacitor (Cs), the output inductor (Lo) and the resonance capacitor (Co). A distinguishing feature of Class E drive circuit 110 is that the AC component of the current (Ils) 114 in the switch inductor (Ls) is much smaller than the DC current 116 flowing through the switch inductor (Ls).

In the Class E drive circuit 110, the current switching device Qs is operated as a switch, either on or off. When on, the current switching device Qs conducts for the low voltage portion of the half sine wave and therefore, minimum power is dissipated. When off, no current flows through the current switching device Qs, and therefore essentially no power is dissipated. In the Class E drive circuit 110, the DC feed inductor Ls has a large value relative to the output inductor Lo, and therefore does not affect the resonance operation of the circuit 110. The resonant frequency of the output inductor Lo and the resonance capacitor Co is chosen to be nominally at Fo, the switching frequency of the current switching device Qs. This is so that the resonant circuit comprising Lo and Co filters out the harmonics of the half sine signal generated across the switch Qs, thereby ensuring that the radiated signal output from the inductor Lo is mostly free of unwanted harmonics. The half sine portion of the signal Vs shown in FIG. 5 is the result of the combined action of Cs, Co and Lo.

In a practical implementation of the Class E driver circuit 110, the resonant frequency of Cs, Co and Lo may be slightly higher than the operating frequency Fo. This is to ensure that signal Vs returns to ground before the current switch Qs is turned on. This minimizes the power losses from the current switch Qs associated with switching. We have determined that a practical implementation of the Class E driver circuit for use as a loop antenna driver is unsuitable because a practical switching device Qs comprises an FET that has a large, non-linear device capacitance. This device capacitance is at maximum when the voltage across the device (Vs) is minimum. In practice, this large non-linear device capacitance causes the resonance frequency of the circuit to be dramatically lower during the immediate period after the FET is turned off. This tends to latch the circuit such that the drive voltage (Vs) is held low long after the FET is turned off. This latching effect can last for more than one cycle, until the current that flows through the DC feed inductor (Ls) increases sufficiently to charge the large non-linear capacitance of the FET sufficiently to pull the circuit out of this state. Thus, in a practical implementation of the Class E driver circuit 110, drive signal cycles may be skipped, due to latching, either periodically (generating a sub-harmonic signal) or randomly (generating a chaotic form of noise). Thus, a practical implementation of the Class E driver circuit 110 is not suitable for use as a driver for a reactive load such as a loop antenna.

Class A, B and C and flyback drivers are more immune to such problems because the resonance of these circuits controls their operation to a much greater extent than that of the Class E circuit. The inductor Ls in the Class A, B and C drive circuits 100 of FIG. 1 and the flyback drive circuit 108 of FIG. 3 is relatively much smaller in value than the inductor Ls of the Class E drive circuit 110. With a relatively small value of Ls, the current increase through Ls (associated with the applied voltage across it when the current switch Qs is conducting) charges the non-linear capacitance of practical switching devices Qs (such as an FET) sufficiently quickly so that the previously described latching does not occur.

However, circuits using these classes (A, B, C) of operation are either inefficient or generate unacceptable harmonics. Despite the availability of many different types of driver circuits, there is still a need for a driver circuit that can efficiently drive reactive loads without the introduction of excessive noise or harmonics and which is suitable for driving an inductive loop antenna. The present invention fulfills such needs.

BRIEF SUMMARY OF THE INVENTION

Briefly stated, the present invention comprises a circuit for driving a reactive load, such as an inductive load or a capacitive load, with high efficiency. The circuit comprises a driver circuit and a coupling reactance, the coupling reactance being either a capacitor or inductor. The driver circuit converts DC input current to RF output current. The reactance is coupled in series between the RF output of the driver circuit and an output resonant circuit. One element of the output resonant circuit is the reactive load. The coupling reactance performs a series to parallel impedance match from the driver circuit to the output resonant circuit.

Another embodiment of the present invention comprises a circuit for driving a reactive load with high efficiency, having a driver circuit, an output resonant circuit, one element of which is the reactive load, and a coupling reactance, the coupling reactance being either a capacitor or inductor. The driver circuit converts DC input current to RF output current. The output resonant circuit has an input for receiving the RF output current. The coupling reactance is connected in series between the RF current output of the driver circuit and the input of the resonant circuit for performing a series to parallel impedance match from the driver circuit to the resonant circuit.

Yet a further embodiment of the invention comprises a circuit for driving a reactive load with high efficiency having a driver circuit comprising an electronic current switch, a flyback inductor and a flyback capacitor configured to generate an RF output current, an output resonant circuit, one element of which is the reactive load, and a coupling reactance, the coupling reactance being either a capacitor or an inductor. The driver circuit generates an RF output current by periodically opening and closing the switch at the RF frequency of operation such that during the period when the switch is closed, the voltage across the switch approaches zero, and during the time the switch is open, a half sine waveform is created due to the resonant action of the flyback inductor and flyback capacitor. The output resonant circuit has an input for receiving the RF output current. The coupling reactance is connected in series between the RF current output of the driver circuit and the input of the resonant circuit for performing a series to parallel impedance match from the driver circuit to the resonant circuit.

Another embodiment of the present invention comprises an electronic article surveillance system having an interrogator for monitoring a detection zone by transmitting an interrogation signal into the detection zone and detecting disturbances caused by the presence of a resonant tag within the detection zone. The interrogator comprises a loop antenna for transmitting the interrogation signal, a resonance capacitor connected across the antenna and a circuit for driving the resulting resonant circuit. The driver circuit has an RF current output and a coupling reactance connected in series between the RF current output of the driver circuit and the antenna resonant circuit. The reactance performs a series to parallel impedance match from the driver circuit to the antenna resonant circuit.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
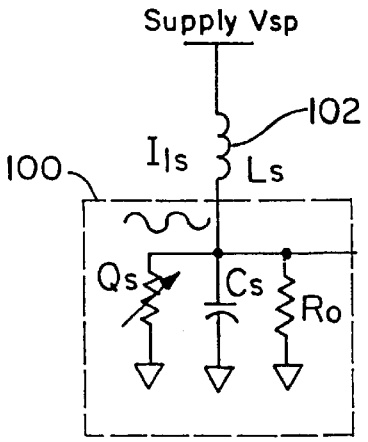
FIG. 1 (PRIOR ART)
FIG. 1 is an electrical schematic diagram of a prior art drive circuit for driving a reactive load.
Figure 2:
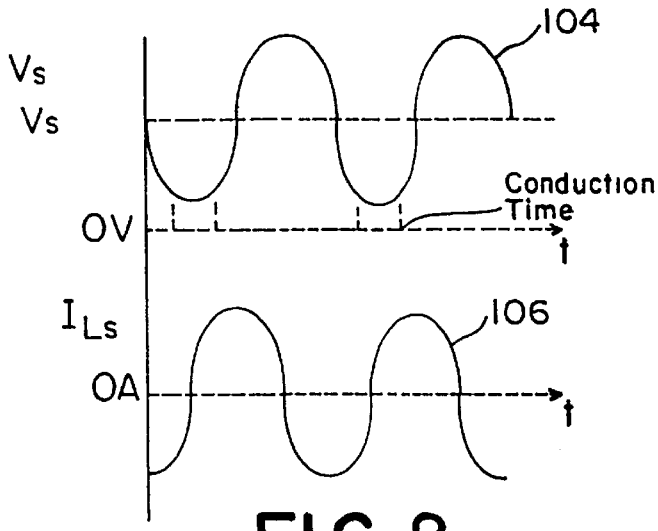
FIG. 2 (PRIOR ART)
FIG. 2 shows voltage and current waveforms associated with the drive circuit of FIG. 1.
Figure 3:
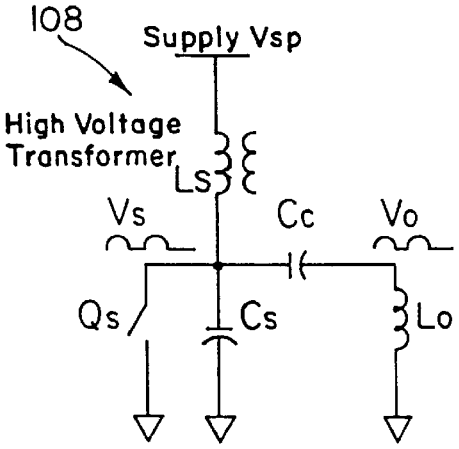
FIG. 3 (PRIOR ART)
FIG. 3 is an electrical schematic diagram of a prior art flyback driver circuit.
Figure 4:
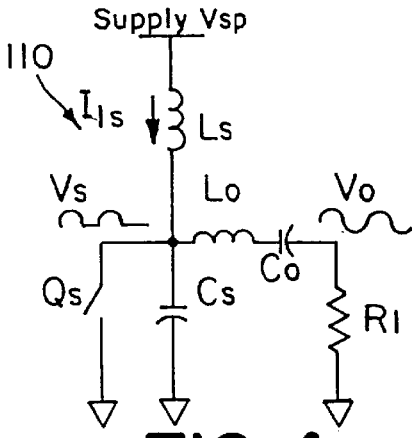
FIG. 4 (PRIOR ART)
FIG. 4 is an electrical schematic diagram of prior art Class E power amplifier used for driving a reactive load.
Figure 5:
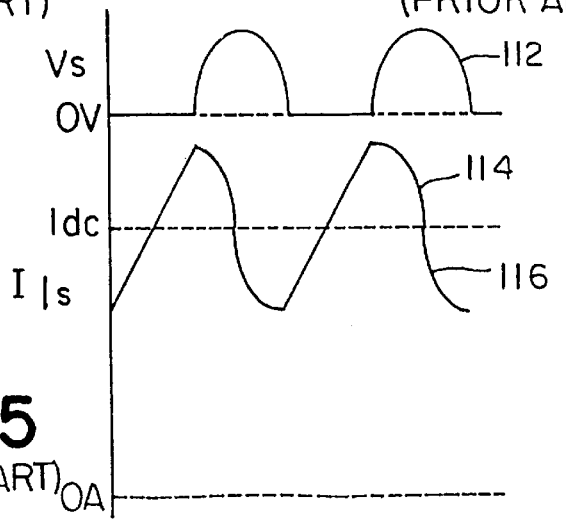
FIG. 5 (PRIOR ART)
FIG. 5 shows voltage and current waveforms associated with the circuit of FIG. 4.

Certain terminology is used herein for convenience only and is not be taken as a limitation on the present invention. In the drawings, the same reference numerals are employed for designating the same elements throughout the several figures.

Figure 6:
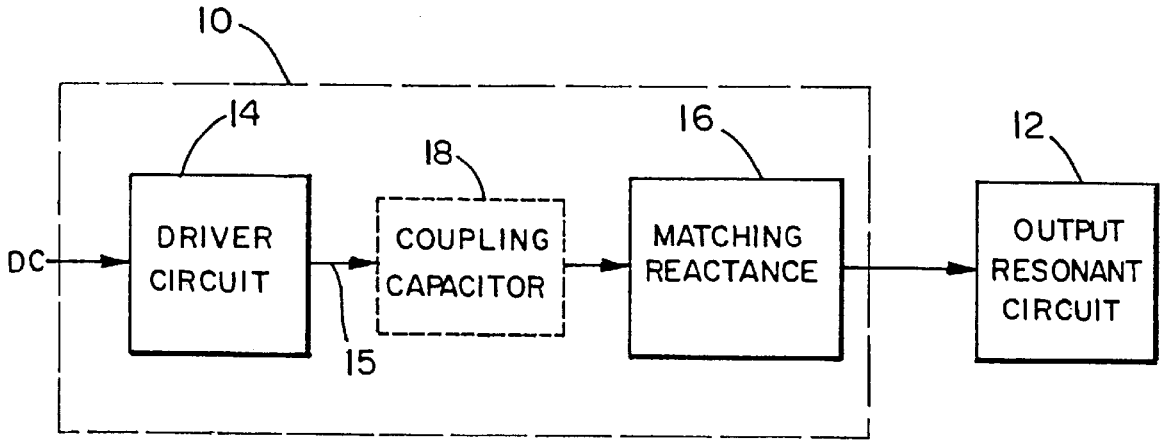
FIG. 6 is a functional schematic block diagram of a circuit in accordance with the present invention which is used to drive a reactive load.
Figure 7A:
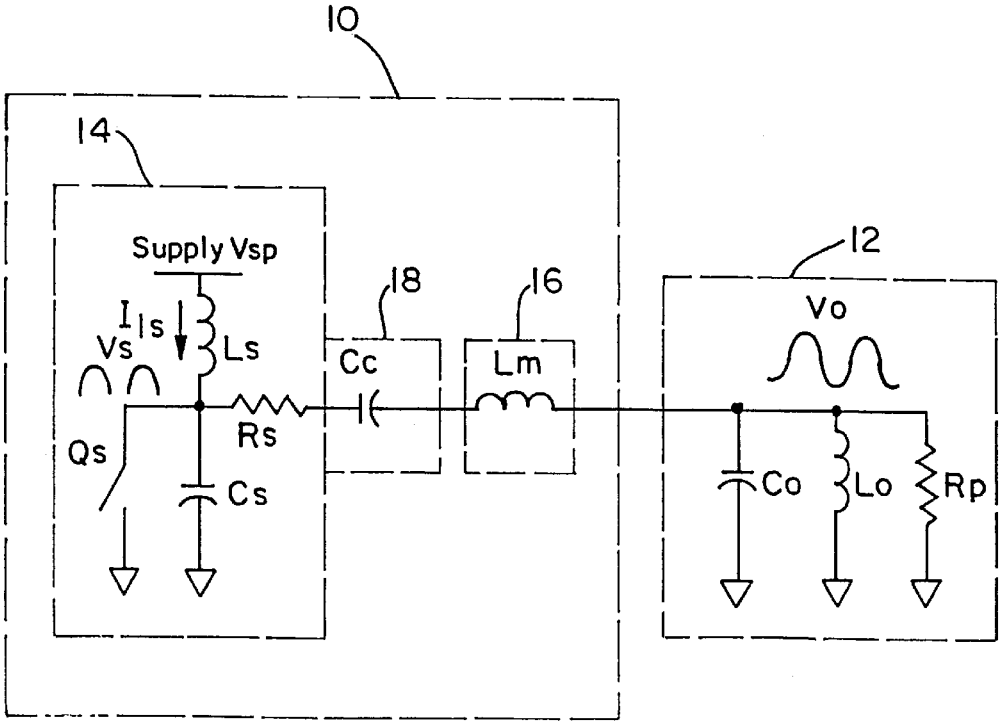
FIG. 7A is an equivalent electrical circuit diagram of one preferred implementation of the circuit of FIG. 6 in a single-ended configuration.

FIG. 6 shows a schematic block diagram of a circuit 10 in accordance with the present invention which is used to drive a reactive load. In the embodiment of the invention shown in FIG. 6, an output resonant circuit 12 is shown comprising at least an inductor and a capacitor, one of which is the reactive load. The inductor may be an inductive loop antenna. The reactive load may comprise either an inductive load or a capacitive load. FIG. 7A shows a circuit diagram of one preferred implementation of the circuits 10 and 12.

Referring to FIG. 6, the circuit 10 includes a driver circuit 14, a coupling or matching reactance (Lm) 16, and an optional coupling capacitor (Cc) 18. The driver circuit 14 converts a DC supply current (Vsp) to RF output current. The matching reactance (Lm) 16 is coupled in series between an RF output 15 of the driver circuit 14 and the input of the resonant circuit 12. According to the present invention, the matching reactance 16 may comprise either a capacitor or an inductor. The matching reactance (Lm) 16 performs a series to parallel impedance match from the output of the driver circuit 14 to the resonant circuit 12. The optional coupling capacitor 18 is coupled in series between the RF output 15 of the driver circuit 14 and the matching reactance (Lm) 16 and blocks the average DC voltage associated with the driver circuit 14 from appearing at the output resonant circuit 12.

Referring to FIG. 7A, the circuit 10 comprises the driver circuit 14, shown in equivalent circuit form, the coupling capacitor (Cc) 18, the matching reactance (Lm) 16, and the reactive load, either Co or Lo, which is part of the output resonance circuit 12. The driver circuit 14 has certain components associated with a Class E power amplifier, including a switching device (Qs), a switch inductor (Ls) and a switch capacitor (Cs). The resonator-equivalent resistance of the driver circuit 14 is represented as Rs. The switching device (Qs) is preferably a power metal oxide semiconductor field effect transistor (MOSFET), but may also comprise any suitable electronic switching device, such as a power bipolar junction transistor (BJT), insulated gate bipolar transistor (IGBT), MOS controlled thyristor (MCT), or vacuum tube.

FIG. 7A shows the driver circuit 14 implemented as a single-ended configuration, wherein the active device conducts with a 50% duty cycle. However, the driver circuit 14 may also be implemented as a push-pull configuration, as shown in FIG. 7B (i.e., differential implementation), wherein there are at least two active devices that alternatively amplify the negative and positive cycles of the input waveform sharing the energy deliverance to the load.

Figure 7B:
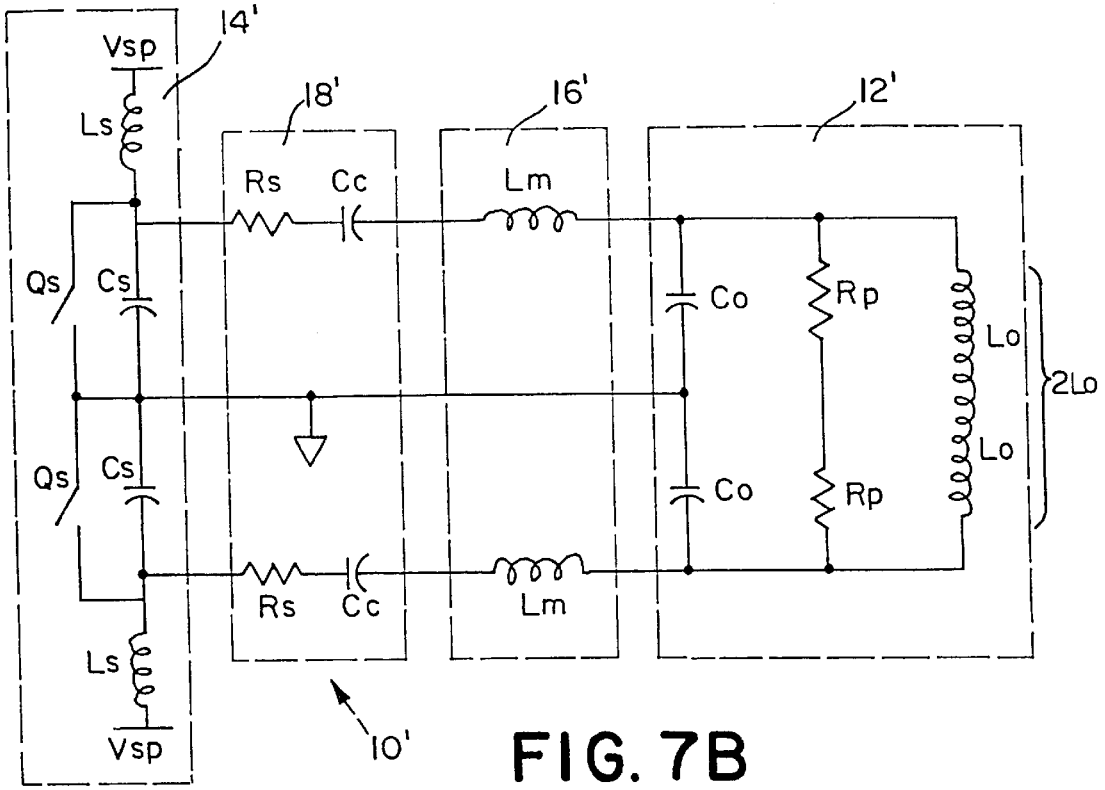
FIG. 7B is an equivalent electrical circuit diagram of a the circuit of FIG. 7A in a push-pull configuration.

Referring now to FIG. 7B, a push-pull configuration of a circuit 10' for driving a reactive load 12' is shown. The circuit 10' comprises a driver circuit 14', shown in equivalent circuit form, including a pair of coupling capacitors (Cc) 18', a pair of matching reactances (Lm) 16', and the reactive load, which is part of an output resonance circuit 12'. In accordance with the push-pull configuration, the driver circuit 14' includes a pair of switching devices (Qs), a pair of inductors (Ls) and a pair of switch capacitors (Cs). The equivalent output resistance of the driver circuit 14' is represented as resistors Rs. As will be understood by those of ordinary skill in the art, the push-pull configuration can have a higher power-conversion efficiency and greater output current than the single-ended configuration. The push-pull configuration also has other advantages, such as nominally canceled even order harmonic content. That is, a half-sine flyback switch waveform output from the driver circuit 14 (discussed in detail below with respect to FIG. 8) produces only even order harmonic content and no odd order harmonic content. In the push-pull configuration, the even order components substantially cancel each other out, so that substantially no harmonic content is created. In practice, it is difficult to produce a perfect half-sine flyback waveform, so complete cancellation can only be approached.

Referring again to FIG. 7A (and inferentially to FIG. 7B), the coupling capacitor (Cc) 18 blocks the average DC voltage associated with the driver circuit 14 from appearing at the output resonant circuit 12. The value of the capacitor 18 is sufficiently large so that it does not affect the operation of the circuit 10.

The matching reactance (Lm) 16 performs a series to parallel impedance match from the driver circuit 14 (which has a resistance (Rs)) to the load (which has a parallel equivalent resistance (Rp), representing the output resistance of the resonant circuit 12). The driver circuit 14 resistance (Rs) is lower than the output or load resistance (Rp). The resonant circuit 12 is not lossless. Accordingly, a certain amount of power must be delivered to the resonant circuit 12 for a given circulating current. At resonance, the power consumption may be represented by the parallel equivalent resistance Rp, which is usually too high (e.g., 3 K to 10 K Ohms) to allow the resonant circuit 12 to be directly connected to the output of the driver circuit 14. If such a direct connection was made, the power transfer would be very inefficient and insufficient power would be transferred. It is desirable to transform this high resistance into a lower resistance (e.g., 5–20 Ohms) to better match the resistance of the switching device (Qs) and its resonance, which allows sufficient power to be delivered to the resonant circuit 12 to permit the circuit 12 to drive the reactive load.

Figure 8:
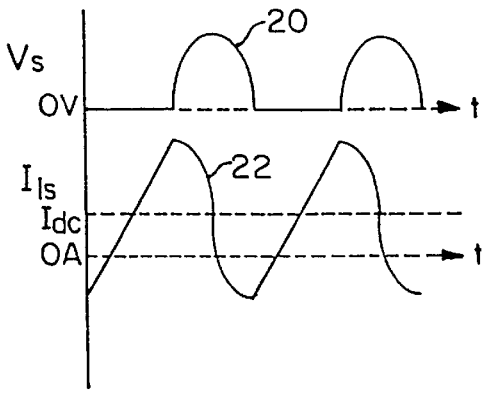
FIG. 8 shows voltage and current waveforms associated with the circuit of FIG. 7A.

FIG. 8 shows voltage and current waveforms associated with the driver circuit 14 of FIG. 7A. The upper waveform 20 shows the input switching voltage waveform (Vs), and the lower waveform 22 shows the current (Ils) through the switch inductor (Ls). The input switching voltage waveform 20 is a half-sine wave.

When the switching device (Qs) is energized or closed, the waveform 20 drops to ground (0 V) for approximately one half of the period of operation. The switch inductor (Ls) charges with increasing current flow as the supply voltage (Vsp) is dropped across it. As the current flow through the inductor (Ls) increases, an increasing amount of energy is stored in the inductor (Ls). When the switching device (Qs) is deenergized or opened for the other half of the period, the waveform (Vs) rises to a peak voltage in sinusoidal fashion, and the stored current in the inductor (Ls) discharges while charging the switch capacitor (Cs) until the stored energy in the inductor (Ls) is transferred to the capacitor (Cs). The peak voltage at this point is directly related to the same energy now stored in the capacitor (Cs) as was stored in the inductor (Ls). The peak voltage causes a reverse current to start flowing in the inductor (Ls). The reverse current discharges the capacitor (Cs) in sinusoidal fashion until the waveform (Vs) returns to ground. According to the present invention, the inductor (Ls) and the capacitor (Cs) are sized so that the half-sine pulse thus formed completes in one quarter to one half of the operating period. This part of the waveform is referred to herein as the "flyback pulse," and is similar in certain respects to the waveform of the CRT sweep circuit discussed above. The half sine or flyback pulse has a limited rate of rise which gives the switching device (Qs) time to turn off while the voltage (Vs) is rising and which reduces switching transition losses in the switching device (Qs).

When the switching device (Qs) is on, there is little or no voltage dropped across it for the current flowing therethrough. Thus, little power is wasted. Conversely, when the switching device (Qs) is off, no real current flows through it (except capacitive) while there is voltage across it. Thus, even though there is a voltage drop across the switching device (Qs), little power is wasted. Theoretically, the circuit 10 is capable of 100% efficiency. Realistically, losses occur as a result of the finite on-resistance of the switching device (Qs), as well as losses associated with the finite time required for the switching device(Qs) to transition from on to off. Typical efficiencies are about 80–90%.

Ideally, the inductor (Ls) and the capacitor (Cs) of the switch resonator are sized so that, when damped by the load (output resonant circuit 12), they will lose all of their stored energy at the completion of the half-sine pulse. This condition occurs for about ¾ of a cycle of the resonant frequency (Fs) of the switch resonator. In the presently preferred embodiment, the switch inductor (Ls) and the switch capacitor (Cs) produce a switch resonance frequency (Fs) from between one to two times the operating frequency (Fo) of the circuit 10.

The peak voltage seen by the switching device (Qs) for a perfect half-sine flyback waveform is about 2.57 times the supply voltage (Vsp). This is due to the fact that the average voltage across the inductor (Ls) must equal zero. Thus, the voltage-time product for the on or low part must equal the voltage-time product for the off or high part of the waveform. If the flyback pulse was a true half sine, then the peak voltage reached would be $\pi/2$ or about 1.57 times the supply voltage (Vsp) over the supply voltage (Vsp), or about 2.57 times the supply voltage relative to ground. Since the natural period of the switch resonator 1/Fs is shorter than one cycle of the operating frequency (Fo), the peak voltages are generally higher. The peak voltages are typically three times the supply voltage (Vsp).

As shown by the lower waveform 22 of FIG. 8, a distinguishing feature of the driver circuit 14 is that the AC component of the current in the inductor (Ls) is larger than the DC current (Idc). The AC component of the current in the inductor (Ls) causes the current (Ils) to periodically become negative. This negative current approaches zero in the ideal driver circuit 14. Also, the current in the inductor (Ls) is not sinusoidal. The reactance of the inductor (Ls) and the capacitor (Cs) is much larger than the resistance of the switching device (Qs) when on. The Q of the switch resonator is less than one when the switching device (Qs) is conducting, and greater than or equal to two when the switching device Qs is non-conducting.

An essential difference between the driver circuit 14 and a prior art Class E amplifier is that the driver circuit 14 maintains a relatively large resonant current at the switching device (Qs) by keeping the value of inductor (Ls) relatively small to eliminate the latching tendencies of the Class E amplifier, discussed above. Because the Q of the switch resonator is less than one when the current switch Qs is on, the waveform generated by the driver is determined predominantly by the switch, whereas in Class A, B and C drivers, the waveform is determined predominantly by the resonator. In this respect, the driver circuit 14 is similar to the CRT sweep circuit discussed above, differing in the addition of the output matching circuit (matching reactance 16). The switch controlled operation is highly efficient.

As discussed above, the matching reactance (Lm) 16 converts the parallel equivalent resistance of the output resonant circuit 12 (which is a resonant antenna comprising an antenna output capacitor (Co) and an output antenna inductor (Lo)) to an equivalent series resistance that is required to draw the correct amount of power from the output of the driver circuit 14. When the matching reactance (Lm) is an inductor, an added benefit is that it forms a two pole low pass filter with the output capacitor (Co). This provides reduction of the harmonic energy generated by the driver circuit 14. Efficient circuits naturally generate significant harmonic energy due to the switching nature of the circuits. Thus, for most applications that desire a single frequency output, this harmonic energy must be filtered and prevented from reaching the output.

The value of the output antenna inductor (Lo) is generally fixed due to known physical constraints on the antenna, such as allowable size, radiation pattern, and the like.

The value of the output resonance capacitor (Co) is selected to resonate the output inductance (Lo) at the operating frequency (Fo), and is adjustable to allow the circuit 12 to be precisely tuned to the operating frequency (Fo), and may be determined by the following equation:

$$Co=1/(4\pi^2 Fo^2 Lo).$$

The parallel equivalent resistance (Rp) is primarily determined by the Qo of the output resonance circuit 12 and to a much lesser extent by the matching inductor 16, and may be determined by the following equation:

$$Rp=QoXLo \text{ where } XLo=2\pi LoFo.$$

To drive a predetermined current through the reactive load, in this case, Lo, a corresponding voltage Vo must be developed across the load, and a corresponding power Po delivered from the driver circuit 14. The amount of power required depends upon the Q of the output resonant circuit 12, which is inversely related to the losses of the resonant circuit 12. For the given current:

$$Vo=IoXLo; \text{ and}$$

$$Po=Vo^2/Rp$$

where Po is the power to be delivered by the driver circuit 14, and XLo is the impedance of the reactance being driven.

The drive resistance (Rs) is determined by the amount of power delivered to the output of the driver circuit 14 based on the supply voltage (Vsp). Since the signal from the driver circuit 14 is usually filtered prior to the output, only the fundamental frequency component of the drive signal delivers any significant power. Also, since the switching device (Qs) waveform is generally square at its bottom, the peak voltage of the fundamental frequency component of the drive signal is generally equal to the supply voltage (Vsp). The RMS voltage of the fundamental frequency component of the drive signal is:

$$Vd=0.5^{1/2}\ Vsp \text{ or } Vd=0.7071\ Vsp.$$

The drive resistance (Rs) can then be calculated by the following equation:

$$Rs=0.5Vsp^2/Po.$$

The matching reactance (Lm) is sized such that its reactance at the operating frequency is the geometric mean between the desired drive resistance (Rs) and the equivalent parallel resistance (Rp) of the output resonant circuit 12. In this condition, the parallel resistance (Rp) produces a certain (Qm) for the inductor (Lm) being the ratio of reactance to resistance measured at the operating frequency. The series resistance (Rs) reflected also produces the same (Qm). The relationship is defined as follows:

$$QmRs=Rp/Qm=Xlm; \text{ or}$$

$$Xlm=(Rs\ Rp)^{1/2}; \text{ and}$$

$$Lm=Xlm/(2\pi Fo).$$

Thus, this value of the reactance (Lm) is determined, which is inversely proportional to the square root of the power delivered to the output.

A minimum preferred value of the switch capacitor (Cs) is selected by producing a Q of about two at the anticipated drive resistance for the power delivered. This Q value causes the resonant energy of the switching device (Qs) to be completely used in about ¾ of the switching device (Qs) resonant cycle. At the end of this period, the flyback portion of the switch waveform has just returned to zero, ready for the next switch on time. Since the switch resonance is parallel:

$$Xcs \leqq Rs/2; \text{ and}$$

$$Cs=1/(2\pi FsXcs),$$

wherein Xcs is the impedance of the switch capacitor (Cs). In practice, the switch capacitor (Cs) is sized to minimize the effects of the nonlinear output capacitance of the switching device (Qs). If these nonlinear effects are not dealt with, they can lead to sub-harmonic and/or chaotic oscillations as discussed above. A maximum preferred value for (Cs) is equal to the maximum capacitance of the current switch (Qs). Under these conditions, the switch capacitor (Cs) is often larger than necessary to produce the damped flyback waveform described above. This results in higher currents in the switch resonator. Any undamped energy (reverse Ils) left at the end of the flyback pulse tries to send the switching device (Qs) waveform below ground to continue the sine wave. This is caught by reverse diodes (not shown) normally associated with the switching device (Qs), or in the on resistance of the switching device (Qs) itself. The result is that this stored reverse switch inductor current is caused to flow back into the supply, thus returning excess stored energy to the supply. As such, there is no upper limit to the size of the switch capacitor (Cs). However, an excessively large capacitor (Cs) needlessly wastes energy because of the losses associated with the components comprising the switch resonator (Qs).

The switch inductor (Ls) is sized to produce a switch resonant frequency from one to two times the operating frequency, as follows:

$$Fo<Fs<(2Fo); \text{ and}$$

$$Ls=1/(4\pi^2 Fs^2 Cs).$$

Figure 9:
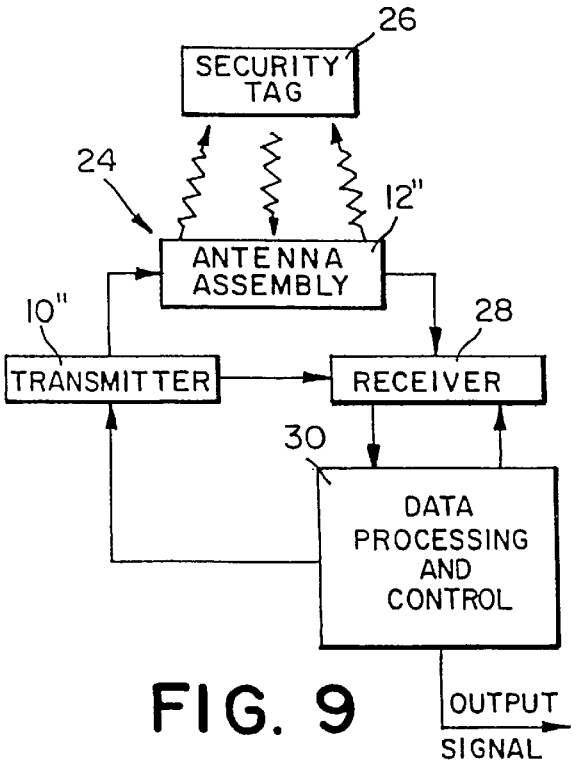
FIG. 9 is a functional block diagram schematic of an interrogator suitable for use with the present invention.

FIG. 9 is a schematic block diagram of an interrogator 24 suitable for use with the present invention. The interrogator 24 and a resonant tag 26 communicate by inductive coupling, as is well-known in the art. The interrogator 24 includes a transmitter 10", receiver 28, antenna assembly 12", and data processing and control circuitry 30, each having inputs and outputs. The output of the transmitter 10" is connected to a first input of the receiver 28, and to the input of the antenna assembly 12". The output of the antenna assembly 12" is connected to a second input of the receiver 28. a first and a second output of the data processing and control circuitry 30 are connected to the input of the transmitter 10" and to a third input of the receiver 28, respectively. Furthermore, the output of the receiver 28 is connected to the input of the data processing and control circuitry 30. Interrogators having this general configuration may be built using circuitry described in U.S. Pat. Nos. 3,752,960, 3,816,708, 4,223,830 and 4,580,041, all issued to Walton, all of which are incorporated by reference in their entirety herein. However, the transmitter 10" and the antenna assembly 12" include the properties and characteristics of the circuit 10 and output resonant circuit 12, described herein. That is, the transmitter 10" is a drive circuit 10 in accordance with the present invention, and the antenna assembly 12" is part of the output resonant circuit 12 in accordance with the present invention. The interrogator 24 may have the physical appearance of a pair of pedestal structures, although other physical manifestations of the interrogator 24 are within the scope of the invention. The interrogator 24 may be used in EAS systems which interact with either conventional resonant tags, or radio frequency identification (RFID) tags.

Due to the high efficiency of the drive circuit 10, it is particularly useful when implemented as a small printed circuit board using surface mount components, where heat dissipation is difficult. The drive circuit of the present invention can control 2000 Volt-Amps of circulating antenna energy at 13.5 MHZ. with about 20 W of power while keeping the harmonics about 50 decibels below the carrier frequency. This amount of antenna energy is sufficient to create an interrogation zone for a six foot aisle using one antenna on each side of the aisle.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A circuit for driving a reactive load with high efficiency, the circuit comprising:

a driver circuit for converting DC input current to RF output current, the driver circuit including only one switch, the driver circuit further including a switch capacitor and a switch inductor, the switch having a nonlinear output capacitance, the switch capacitor being equal to a maximum of the switch output capacitance to minimize the effects of the nonlinear output capacitance of the switch, wherein the switch capacitor has a value of $(1/(2\pi FsXcs))$, wherein $Xcs \leqq Rs/2$, Fs being the resonance frequency of the switch, Xcs being the impedance of the switch capacitor, and Rs being the series output resistance of the driver circuits;

an output resonant circuit including the reactive load; and a coupling reactance coupled in series between the RF output current of the driver circuit and an input of the output resonant circuit, the coupling reactance performing a series to parallel impedance match from the driver circuit to the output resonant circuit.

2. A circuit for driving a reactive load with high efficiency, the circuit comprising:

a driver circuit for converting DC input current to RF output current, the driver circuit including only one switch, the driver circuit further including a switch capacitor and a switch inductor, the switch having a nonlinear output capacitance, the switch capacitor being equal to a maximum of the switch output capacitance to minimize the effects of the nonlinear output capacitance of the switch, wherein the switch inductor is selected to have a value of $(1/(4\pi^2Fs^2Cs))$, wherein $Fo<Fs<2Fo$, Fs being the switch resonance frequency, Cs being the value of the switch capacitor, and Fo being the operating frequency of the circuit;

an output resonant circuit including the reactive load; and a coupling reactance coupled in series between the RF output current of the driver circuit and an input of the output resonant circuit, the coupling reactance performing a series to parallel impedance match from the driver circuit to the output resonant circuit.

3. A circuit for driving a reactive load with high efficiency, the circuit comprising:

a driver circuit for converting DC input current to RF output current, the driver circuit including only one switch, the driver circuit further including a switch capacitor and a switch inductor, the switch having a nonlinear output capacitance, the switch capacitor being equal to a maximum of the switch output capacitance to minimize the effects of the nonlinear output capacitance of the switch, wherein the values of the switch, switch inductor and switch capacitor are selected so that the Q of the switch resonance is less than one when the switch is closed and greater than or equal to two when the switch is open;

an output resonant circuit including the reactive load; and a coupling reactance coupled in series between the RF output current of the driver circuit and an input of the output resonant circuit, the coupling reactance performing a series to parallel impedance match from the driver circuit to the output resonant circuit.

4. A circuit for driving a reactive load with high efficiency, the circuit comprising:

a driver circuit for converting DC input current to RF output current, the driver circuit having a differential implementation including a first switch and a second switch;

an output resonant circuit including the reactive load; and a coupling reactance coupled in series between the RF output current of the driver circuit and an input of the output resonant circuit, the coupling reactance performing a series to parallel impedance match from the driver circuit to the output resonant circuit, the coupling reactance including a first reactance coupled in series between the RF output current of the driver circuit associated with the first switch and an input of the output resonant circuit, and a second reactance coupled in series between the RF output current of the driver circuit associated with the second switch and an input of the output resonant circuit.

5. A circuit for driving a reactive load with high efficiency comprising:

a driver circuit for converting DC input current to RF output current, the driver circuit having a differential implementation including a first switch and a second switch;

an output resonant circuit including the reactive load and an input for receiving the RF output current; and a coupling reactance electrically connected in series between the driver circuit and the input of the resonant circuit for performing a series to parallel impedance match from the driver circuit to the resonant circuit, the coupling reactance including a first reactance coupled in series between the RF output current of the driver circuit associated with the first switch and an input of the output resonant circuit, and a second reactance coupled in series between the RF output current of the driver circuit associated with the second switch and an input of the output resonant circuit.

6. In an electronic article surveillance system, an interrogator for monitoring a detection zone by transmitting an interrogation signal into the detection zone and detecting disturbances caused by the presence of a resonant tag within the detection zone, the interrogator comprising:

a loop antenna for transmitting the interrogation signal;

a resonance capacitance connected across the antenna, the antenna and the capacitance forming a resonant circuit; and a driver circuit having an RF output current for driving the resonant circuit, the driver circuit having a differential implementation including a first switch and a second switch, the circuit including a coupling reactance connected in series between the RF output current of the driver circuit and the resonant circuit for performing a series to parallel impedance match from the driver circuit to the resonant circuit, the coupling reactance including a first reactance coupled in series between the RF output current of the driver circuit associated with the first switch and an input of the output resonant circuit, and a second reactance coupled in series between the RF output current of the driver circuit associated with the second switch and an input of the output resonant circuit.

* * * * *